US009385406B2

(12) United States Patent
Helszajn

(10) Patent No.: US 9,385,406 B2
(45) Date of Patent: Jul. 5, 2016

(54) NON-RECIPROCAL GYROMAGNETIC PHASE SHIFT DEVICES USING MULTIPLE FERRITE-CONTAINING SLABS

(71) Applicant: APOLLO MICROWAVES, LTD, Dorval (CA)

(72) Inventor: Joseph Helszajn, Edinburgh (GB)

(73) Assignee: Apollo Microwaves, Ltd., Dorval (CA)

( * ) Notice: Subject to any disclaimer, the term of this patent is extended or adjusted under 35 U.S.C. 154(b) by 125 days.

(21) Appl. No.: 14/105,466

(22) Filed: Dec. 13, 2013

(65) Prior Publication Data

US 2014/0167873 A1 Jun. 19, 2014

Related U.S. Application Data

(60) Provisional application No. 61/737,586, filed on Dec. 14, 2012.

(51) Int. Cl.
*H01P 1/19* (2006.01)
*H01P 1/18* (2006.01)

(52) U.S. Cl.
CPC ..... *H01P 1/182* (2013.01); *H01P 1/181* (2013.01); *H01P 1/19* (2013.01)

(58) Field of Classification Search
CPC ..... H01P 1/181; H01P 1/182; H01P 1/19
USPC ..... 333/24.1, 24.2, 24.3, 158
See application file for complete search history.

(56) References Cited

U.S. PATENT DOCUMENTS 2,934,720 A 4/1960 Pierre
3,016,495 A 1/1962 Tien
3,051,908 A 8/1962 Anderson
3,101,458 A 8/1963 Chandler et al.
3,214,711 A * 10/1965 Lyon ..... H01P 1/11 333/102
3,235,819 A 2/1966 Carvelas et al.
3,274,519 A 9/1966 Nathanson
3,368,169 A 2/1968 Carter
3,425,001 A 1/1969 Hershenoy
3,519,956 A 7/1970 Hai et al.
4,349,790 A 9/1982 Landry
4,353,042 A 10/1982 D'Oro et al.
4,682,126 A * 7/1987 Milberger ..... H01F 7/06 333/1.1
4,818,963 A 4/1989 Green (Continued)

OTHER PUBLICATIONS

Bolle, D.M., and Talisa, S.H., "the edge guided mode non-reciprocal phase shifter", IEEE Trans. Microwave Theory and Tech., vol. MTT-29, vol. 12, pp. 878, Nov. 1979.

(Continued)

*Primary Examiner* — Stephen E Jones

(74) *Attorney, Agent, or Firm* — Wolf, Greenfield & Sacks, P.C.

(57) ABSTRACT

A non-reciprocal gyromagnetic phase shift device for microwave signals is provided. The device has a section of waveguide with at least two stacked chambers in each of which ferrite-containing slabs are arranged opposite one another on top and bottom walls of the stacked chambers along a common axis, in use a magnetic field being applied to the section of waveguide along the common axis along which are positioned the ferrite-containing slabs. The phase shift device proposed may be used in different microwave circuits. For example, it may be combined with a folded magic tee and a 3 dB hybrid coupler in order to form a 4-port differential phase shift circulator.

22 Claims, 8 Drawing Sheets

(56) References Cited

U.S. PATENT DOCUMENTS

| | | | |
|---|---|---|---|
| 5,170,138 | A | 12/1992 | Roberts et al. |
| 5,218,327 | A | 6/1993 | Calabrese |
| 6,104,342 | A | 8/2000 | Noel et al. |
| 6,867,664 | B2 | 3/2005 | Bray et al. |
| 6,885,257 | B2 | 4/2005 | Kroening |
| 8,173,943 | B2 | 5/2012 | Ristola et al. |
| 8,324,539 | B2 | 12/2012 | Hallac et al. |
| 2006/0021980 | A1 | 2/2006 | Lee et al. |

OTHER PUBLICATIONS

Fox, A.G., Miller, S.E. and Weiss, M.T.,"Behaviour and Application of Ferrites in the Microwave Region," Bell Syst. Tech. J., vol. 34, pp. 5-103, 1955.

Helszajn, J. and Walker, P.N., "Operation of High Peak Power Differential Phase Shift Circulators at Direct Magnetic Fields Between Subsidiary and Main Resonances", IEEE Trans. Microwave Theory and Tech., vol. MTT-26, vol. 9, pp. 653-658, Sep. 1978.

Helszajn, J., "Phase in non-reciprocal gyromagnetic waveguides using multiple ferrite tiles," Microwaves, Antennas & Propagation, IET , vol. 7, No. 5, pp. 347,355, Apr. 11, 2013.

Hines, M.F., "Reciprocal and nonreciprocal modes of propagation in ferrite stripline and microstrip devices", IEEE Trans. Microwave Theory and Tech., vol. MTT-19, vol. 6, pp. 442-451, Sep. 1971.

Joseph R.I. and Schlomann E., "Demagnetizing field in nonellipsoidal bodies", J. Appl. Phys., vol. 36, pp. 1579-1593, May 1965.

Melchor J.L. and Vartanian P.H. "Temperature Effects in Microwave Ferrite Devices." Transactions on Microwave Theory and Techniques vol. 7, No. 1, pp. 15-18, Jan. 1959.

Zhang et al., "Design of Non-Reciprocal Waveguide Devices Based on Two-Dimensional Magneto-Optical Photonic Crystals", Optics and laser Technology, vol. 50, p. 195-201, Mar. 3, 2013.

* cited by examiner

NON-RECIPROCAL GYROMAGNETIC PHASE SHIFT DEVICES USING MULTIPLE FERRITE-CONTAINING SLABS

CROSS-REFERENCE TO RELATED APPLICATION

For the purpose of the United States, the present application claims the benefit of priority under 35 USC §119e) based on U.S. provisional patent application Ser. No. 61/737,586 filed on Dec. 14, 2012 by Joseph Helszajn and presently pending. The contents of the above-referenced document are incorporated herein by reference.

FIELD OF THE INVENTION

This application relates generally to the field of microwave components and, more specifically, to non-reciprocal gyromagnetic phase shift devices for use in controlling the phase of microwave signals travelling in microwave waveguides.

BACKGROUND

In many applications, it is necessary to control the phase of microwave signals travelling in waveguides from one point in space to another, for example, to and from microwave antennas, transmitters, receivers and other microwave loads. In this regard, various practical non-reciprocal gyromagnetic phase shift devices have been previously suggested.

Non-reciprocal gyromagnetic phase shift devices are widely used in the design of waveguide devices. Typically, non-reciprocal gyromagnetic phase shift device are coupled with other waveguide devices to form a microwave circuit having certain properties. Such non-reciprocal gyromagnetic phase shift devices typically include a pair of side-by-side waveguide sections having ferrite-containing materials and providing the phase shift functionality.

A deficiency associated with many non-reciprocal gyromagnetic phase shift devices used to control the phase of microwave signals travelling in waveguides is that they are bulky and/or have insufficient power capability and/or suffer from performance degradation due to insufficient cooling during operation.

In light of the above, there is a need to provide improved non-reciprocal gyromagnetic phase shift devices that alleviate at least in part the deficiencies of the existing devices.

SUMMARY

In accordance with a first aspect, the invention relates to a non-reciprocal gyromagnetic phase shift device for microwave signals. The device comprises a section of waveguide having at least two stacked chambers in each of which ferrite-containing slabs are arranged opposite one another on top and bottom walls of the stacked chambers along a common axis. In use, a magnetic field is applied to the section of waveguide along the common axis along which are positioned the ferrite-containing slabs.

In practical implementations, the application of the magnetic field along the common axis along which are positioned the ferrite-containing slabs causes respective counter-rotating circularly polarized alternating magnetic fields to be generated in the at least two stacked chambers, which in turn causes a change in the phase of microwave signals propagating through the section of waveguide.

In some specific implementations, the proposed non-reciprocal gyromagnetic phase shift device may provide advantages over non-reciprocal gyromagnetic phase shift devices using single/non-stacked chambers such as, for example, an increase in the continuous wave (CW) power rating of the device, an increase in the overall phase shift afforded by the device without increasing the overall length of the device and/or without increasing the thickness of the ferrite-containing slabs, and an increase in the slabs surface area in contact with the device enclosure. It is noted that increasing the CW power rating increases the power capability of the device in a given waveguide application, which is desirable in some implementations. It is also noted that reducing the overall length of the device without increasing the thickness of the ferrite-containing slabs and/or the overall length of the device required for obtaining a desired phase shift may result in a more compact device. It is also noted that during operation, a temperature rise of the ferrite-containing slabs may result in variations in specific characteristics of ferrite-containing material thereby degrading the function of the phase shift device. Increasing the surface area of the ferrite slabs that is in contact with the device enclosure (which essentially corresponds to the walls of the chambers) may facilitate the dissipation of heat away from the ferrite slabs thereby reducing the degradation of the properties of the ferrite slabs that would otherwise be caused by overheating. In particular, and as will be appreciated by the person skilled in the art, the proposed configuration allows for the power dissipation to be distributed over a multiple number of ferrite slabs.

In a specific example of implementation, the ferrite-containing slabs extend longitudinally along at least a portion of the section of waveguide.

In a specific example of implementation, the section of waveguide is a section of rectangular waveguide and the at least two stacked chambers have generally rectangular cross-sectional shapes. In a specific example of implementation, the two stacked chambers have substantially similar dimensions to one another and in particular have substantially similar heights and widths.

In a specific example of implementation, the ferrite-containing slabs are located at a position offset from a center line of the at least two stacked chambers.

In a specific example of implementation, the device further comprises at least one magnet configured for causing the magnetic field to be applied to the section of waveguide along the common axis along which are positioned the ferrite-containing slabs.

According to a specific variant, the common axis is a first common axis and the ferrite-containing slabs arranged along the first common axis form a first set of ferrite-containing slabs. The magnetic field applied during use to the section of waveguide along the first common axis is a first magnetic field. According to this specific variant, in each of the at least two stacked chambers, additional ferrite-containing slabs are arranged opposite one another on top and bottom walls of the stacked chambers along a second common axis, the second common axis being distinct from the first common axis. The ferrite-containing slabs arranged along the second common axis form a second set of ferrite-containing slabs. In use, a second magnetic field is applied to the section of waveguide along the second common axis. The first magnetic field is of inverse polarity relative to the second magnetic field.

The device may further comprise at least a first magnet configured for causing the first magnetic field to be applied to the section of waveguide along the first common axis along which are positioned the ferrite-containing slabs in said first set of ferrite-containing slabs and at least a second magnet configured for causing the second magnetic field to be applied to the section of waveguide along the second common axis along which are positioned the ferrite-containing slabs in said second set of ferrite-containing slabs.

In a specific example of implementation of the above variant, the first common axis and the second common axis are arranged on either side of a symmetry plane extending longitudinally along a length of the section of waveguide.

Alternative examples of implementation of the device may include any number of stacked chambers and are not limited to two stacked chambers. In non-limiting examples, the device may include three, four or eight stacked chambers. It is to be appreciated that any number of stacked chambers may be used, the number of chambers being restricted to the physical realization of the device.

According to a specific variant, the non-reciprocal gyromagnetic phase shift device includes a magnet located in a dividing wall between the at least two chambers.

In accordance with another aspect, the invention relates to a non-reciprocal gyromagnetic phase shift device for microwave signals comprising a section of waveguide including:

- a first chamber defining a first microwave transmission passage, the first chamber including a first pair of ferrite-containing slabs wherein one element of the first pair is positioned on a first wall of the first chamber and an other element of the first pair is positioned on a second wall of the first chamber, the first wall of the first chamber being positioned opposite the second wall of the first chamber;
- a second chamber stacked upon the first chamber and defining a second microwave transmission passage, the second chamber including a second pair of ferrite-containing slabs wherein one element of the second pair is positioned on a first wall of the second chamber and an other element of the second pair is positioned on a second wall of the second chamber, the first wall of the second chamber being positioned opposite the second wall of the second chamber.

The first pair of ferrite-containing slabs and the second pair of ferrite-containing slabs are positioned substantially along a common axis. In use, a magnetic field is applied through the first and second chambers along the common axis along which are positioned the first pair of ferrite-containing slabs and the second pair of ferrite-containing slabs.

In a specific example of implementation, at least one of the previously described non-reciprocal gyromagnetic phase shift device is comprised in a 4-port differential phase shift circulator.

In accordance with another aspect, the invention relates to a 4-port differential phase shift circulator comprising a folded magic tee portion, a non-reciprocal phase shift device portion and a 3 dB hybrid coupler portion, wherein the non-reciprocal phase shift device portion includes a non-reciprocal gyromagnetic phase shift device of the type described above.

Other aspects and features of the present invention will become apparent to those ordinarily skilled in the art upon review of the following description of specific embodiments of the invention in conjunction with the accompanying drawings.

BRIEF DESCRIPTION OF THE DRAWINGS

A detailed description of specific embodiments of the present invention is provided herein below with reference to the accompanying drawings in which.

In some of the drawings, embodiments of the invention are illustrated by way of example. It is to be expressly understood that the description and drawings are only for the purpose of illustrating certain embodiments of the invention and are an aid for understanding. They are not intended to be a definition of the limits of the invention.

DETAILED DESCRIPTION OF EMBODIMENTS

Specific examples of non-reciprocal gyromagnetic phase shift devices for microwave signals will now be described to illustrate the manner in which the principles of the invention may be put into practice. Such non-reciprocal gyromagnetic phase shift devices may have particular utility in satellite communications equipment encompassing both ground and space segments, as well as in the radar and the medical fields.

Figure 1:
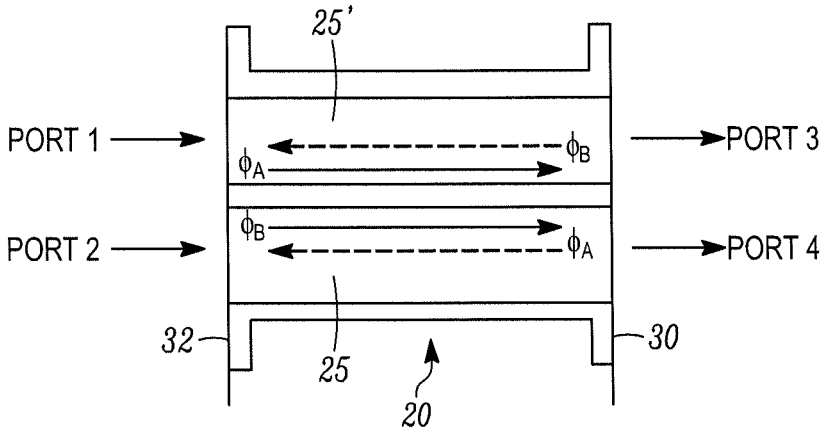
FIG. 1 shows a non-reciprocal phase shift device including a first waveguide section and a second waveguide section in accordance with a specific example of implementation of the invention.

FIG. 1 shows a simplified diagram of a non-reciprocal phase shift device 20 in accordance with an embodiment of the invention. As shown, the non-reciprocal phase shift device 20 includes a pair of side-by-side waveguide sections 25 and 25' defining microwave transmission passages providing phase shift functionality. Ports (1, 3) and (2, 4) are provided on either end of the waveguide sections 25 25'. In the transmission passages defined by waveguide sections 25 and 25', ferrite elements are positioned and suitably magnetized during use in order to provide the non-reciprocal phase shift functionality of the device 20.

In practical implementations, the non-reciprocal gyromagnetic phase shift device 20 may also include coupling members 30 and 32 located at the extremities of the device 20 for allowing the device 20 to be coupled with other devices to form various microwave propagation circuits known in the art. The coupling members may be configured in any suitable manner known to those skilled in the art.

In use, the sections 25 and 25' are oppositely magnetized in order to produce a differential phase shift between the two sections 25 and 25'. Magnetization is obtained via mechanisms known in the art and is applied perpendicular to the direction of wave propagation. For example, a magnetic field may be applied by way of a permanent magnet, an electromagnet, or a combination thereof. For their operation, the waveguide sections rely on the existence of natural planes of counter-rotating circularly polarized alternating magnetic fields on either side of their symmetry plane. In a practical example, with reference to FIG. 1, a wave applied at port 1 and travelling through the first section 25' of the non-reciprocal phase shift device 20 will have its phase shifted by the non-reciprocal phase shift device 20 by $\Phi_A$ before it is released at port 3. Similarly, a wave travelling applied at port 2 and travelling through the second section 25 of the non-reciprocal phase shift device 20 will be phase shifted by $\Phi_B$, before it exits at port 4 wherein $\Phi_A=\Phi_B+90°$.

The transmission passages defined by waveguide sections 25 and 25' and the ferrite elements may be configured in many different manners, examples of which will now be described with reference to the figures, in order to achieve desired non-reciprocal phase shift functionality. It is noted that in practical implementation, waveguide sections 25 and 25' have substantially similar configurations and thus, for the purpose of simplicity, specific examples of configurations for waveguide sections 25 will be described with the understanding that the counterpart configuration of waveguide sections 25' will be substantially similar.

Figure 2:
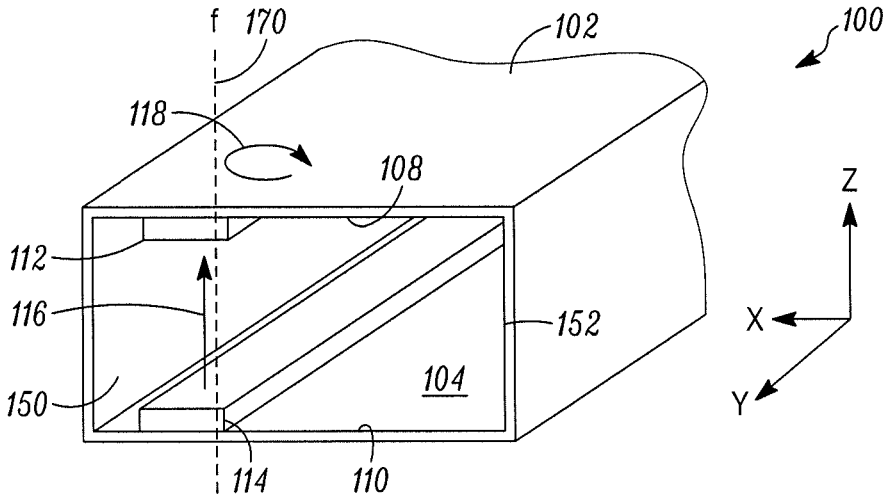
FIG. 2 shows a waveguide section of the non-reciprocal phase shift device shown in FIG. 1 in accordance with a first example of implementation.

FIG. 2 shows a portion of waveguide section 25 of the non-reciprocal phase shift device 20 shown in FIG. 1 in accordance with a first example of implementation (denoted with reference numeral 100 in FIG. 2). In the first example of implementation shown in FIG. 2, the waveguide section 100 is comprised of a metal housing 102 in which is defined a chamber 104 having a generally rectangular cross-section and forming a wave transmission passage. The chamber 104 includes a top wall 108 and a bottom wall 110 as well as side walls 150 and 152, wherein the top and bottom walls 108 110 correspond to the broad walls of the chamber 104. The chamber 104 also includes a pair of opposed ferrite-containing slabs, namely 112 and 114, wherein one of the slabs 112 is located on the top wall 108 and the other slab 114 is located on the bottom wall 110. The ferrite-containing slabs 112 and 114 in the pair are substantially aligned with one another along axis "f" 170 and extend along at least a portion of the transmission passage defined by the chamber 104. In the example depicted, the two ferrite-containing slabs 112 114 are located offset from a center line of the chamber 104. During use, when suitably magnetized, the ferrite-containing slabs 112 and 114 generate a counter-rotating circularly polarized alternating magnetic field, which changes the phase of the microwave signal propagating within the transmission passage. In particular, the ferrite-containing slabs 112 114 are magnetized and the generated magnetic field 116 is generally perpendicular to the direction of propagation of the microwave signal through the chamber 104, which essentially corresponds to the y-axis shown in FIG. 2. The dimensions of the chamber 104 and of the ferrite containing slabs 112 and 114 as well as the positioning of the ferrite containing slabs within the chamber may be established using techniques known in the art including experimental techniques. For a description of a manner in which such dimensions and characteristics may be determined, the reader is invited to refer to J. Helszajn, "Phase in non-reciprocal gyromagnetic waveguides using multiple ferrite tiles", IET Microw. Antennas Propag., 2013, Vol. 7, Iss. 5 (Apr. 11, 2013), pp. 347-355. The contents of the aforementioned document are incorporated herein by reference.

Figure 3:
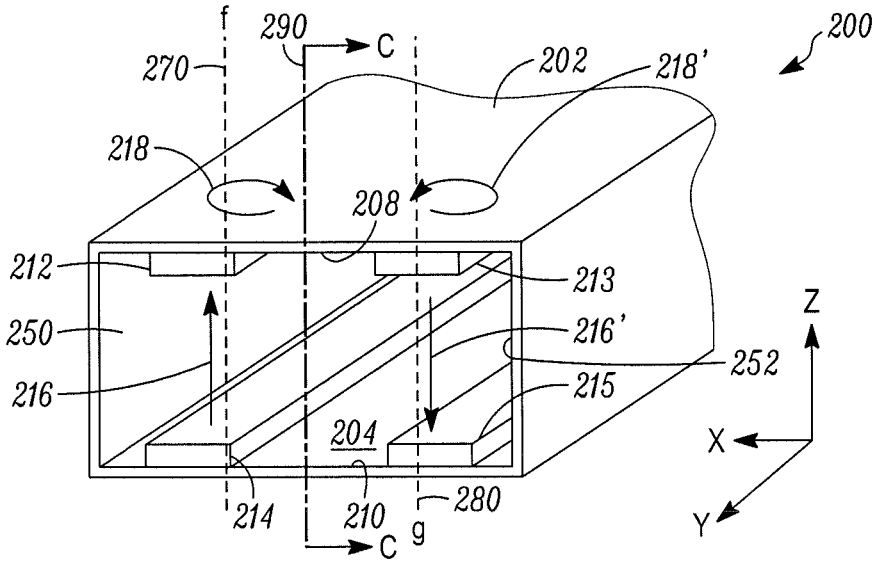
FIG. 3 shows a waveguide section of the non-reciprocal phase shift device shown in FIG. 1 in accordance with a second example of implementation.

FIG. 3 shows a portion of waveguide section 25 of the non-reciprocal phase shift device 20 shown in FIG. 1 in accordance with a second example of implementation (denoted with reference numeral 200 in FIG. 3). In the second example of implementation shown in FIG. 3, the waveguide section 200 is comprised of a metal housing 202 in which is defined a chamber 204 having a generally rectangular cross-section and forming a wave transmission passage. The chamber 204 includes a top wall 208 and a bottom wall 210 as well as side walls 250 and 252, wherein the top and bottom walls 208 210 correspond to the broad walls of the chamber 204. The chamber 204 also includes two pairs of opposed ferrite-containing slabs 212 214 and 213 215 positioned on its top 208 and bottom 210 walls respectively. In particular, the chamber 204 also includes a first pair of ferrite-containing slabs, namely 212 and 214, wherein one of the slabs 212 is located on the top wall 208 and the other slab 214 is located on the bottom wall 210. The ferrite-containing slabs 212 and 214 in the pair are substantially aligned with one another along axis "f" 270 and extend along at least a portion of the transmission passage defined by the reference to FIG. 2. As mentioned earlier, during operation, a temperature rise of the ferrite-containing slabs may result in variations in specific characteristics of ferrite-containing material thereby degrading the function of the phase shift device 20. Increasing the surface area of the ferrite slabs that is in contact with the device enclosure (which essentially corresponds to the walls of the chambers) may facilitate the dissipation of heat away from the ferrite slabs thereby reducing the degradation of the properties of the ferrite slabs that would otherwise be caused by overheating. As such, the configuration described with reference to FIG. 3 allows for an increase of heat transfer away from the ferrite-containing slabs to the device enclosure relative to the configuration illustrated in FIG. 2. As another example, the configuration described with reference to FIG. 3 affords twice the overall phase shift in a wave propagated in the waveguide relative to the configuration described with reference to FIG. 2. As a result, the configuration illustrated in FIG. 3 normally requires about half the length in waveguide transmission passage for a same thickness of ferrite-containing slabs to obtain a same phase shift as with the configuration illustrated in FIG. 2. Alternatively, a phase shift device including a pair of sections of waveguide configured in the manner described with reference to FIG. 3 can yield the same phase shift as a device including a pair of sections of waveguide configured in the manner shown in FIG. 2 using thinner ferrite-containing slabs, or by both using thinner ferrite-containing slabs and a shorter waveguide transmission passage. As was mentioned earlier in the present document, reducing the overall length of the phase-shift device 20 and/or reducing the thickness of the ferrite while obtaining a desired phase shift results in a more compact device, which may be desirable in some applications.

Figure 4A:
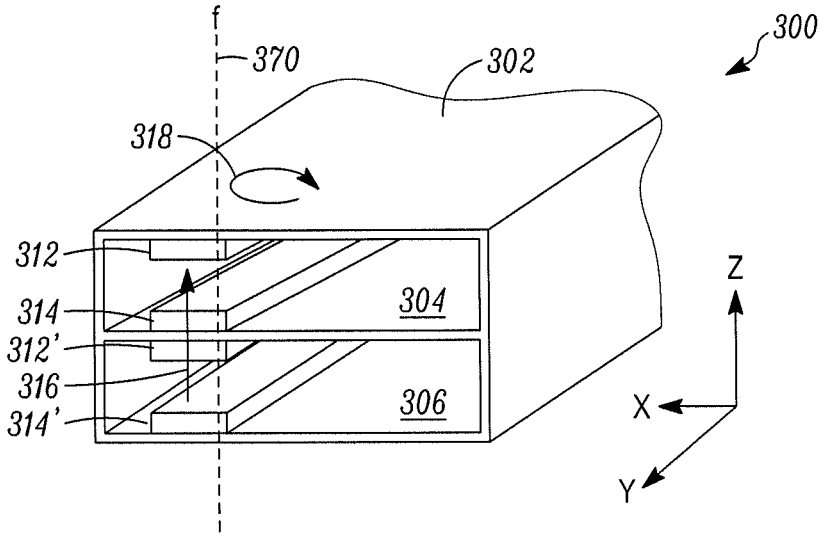
FIG. 4A shows a waveguide section of a non-reciprocal phase shift device shown in FIG. 1 having two stacked chambers in accordance with a third example of implementation.
Figure 4B:
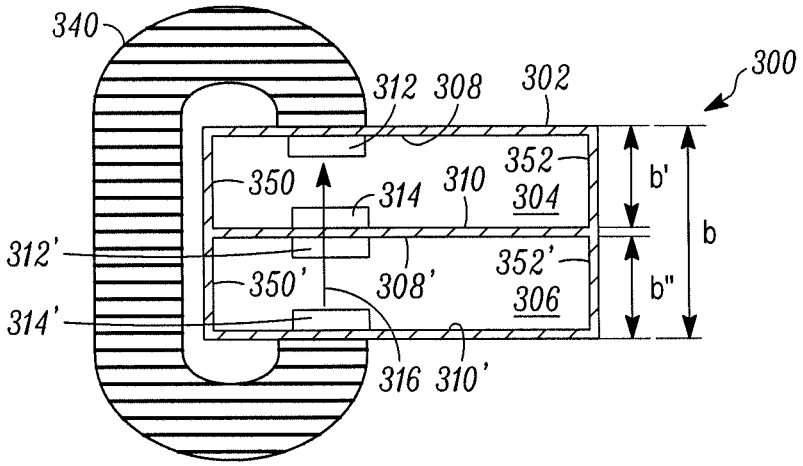
FIG. 4B shows a cross-section of the waveguide section depicted at FIG. 4A together with a magnet 340 in accordance with a non-limiting example of implementation.

FIGS. 4A and 4B show a portion of waveguide section 25 of the non-reciprocal phase shift device 20 shown in FIG. 1 in accordance with a third example of implementation (denoted with reference numeral 300 in FIGS. 4A and 4B). In the third example of implementation, the waveguide section 300 is comprised of a metal housing 302 in which are defined two stacked chambers 304 and 306, namely an upper chamber 304 and a lower chamber 306, having generally rectangular cross-sections and forming respective wave transmission passages. In the example depicted, the stacked chambers 304 306 have substantially similar dimensions and in particular the same height b' and b", where b'=b". It is however to be appreciated that in alternate chamber 204. In the example depicted, the two ferrite-containing slabs 212 214 are located offset from a center line of the chamber 204. The chamber 204 also includes a second pair of ferrite-containing slabs, namely 213 and 215, wherein one of the slabs 213 is located on the top wall 208 and the other slab 214 is located on the bottom wall 210. The ferrite-containing slabs 212 and 214 in the pair are substantially aligned with one another along axis "g" 280 and extend along at least a portion of the transmission passage defined by the chamber 204. In the example depicted, the two ferrite-containing slabs 212 214 are located offset from a center line of the chamber 204. In the specific example of implementation depicted in the figures, the two pairs of opposed ferrite-containing slabs 212 214 and 213 215 are located on alternate sides of a symmetry plane C 290 of the chamber 204 and offset from the center of the chamber 204.

During use, when suitably magnetized, the ferrite-containing slabs 212 214 213 and 215 generate counter-rotating circularly polarized alternating magnetic fields, which changes the phase of the microwave signal propagating within the transmission passage. For its operation, the waveguide section 200 relies on the existence of natural planes of counter-rotating circularly polarized alternating magnetic fields 218 and 218'. In particular, during use, the ferrite-containing slabs 212 213 and 214 215 are magnetized and the generated magnetic fields 216 and 216' are opposite one another and generally perpendicular to the direction of propagation of the microwave signal through the chamber 204, which essentially corresponds to the y-axis shown in FIG. 3.

A non-reciprocal phase shift device, of the type depicted in FIG. 1, having waveguide sections 25 and 25' configured in the manner described with reference to FIG. 3 presents some advantages over a non-reciprocal phase shift device having waveguide sections 25 and 25' configured in the manner described with reference to FIG. 2. For example, the configuration described with reference to FIG. 3 affords an increased CW power rating relative to the configuration described with reference to FIG. 2. As mentioned earlier in the present document, increasing the CW power rating increases the power capability of the device in a given wave application, which is desirable in some implementations. As another example, the configuration described with reference to FIG. 3 has a greater the surface area of the ferrite-containing slabs that is in contact with the walls of the device 20 relative to the configuration described with embodiments (not shown in the Figures), the height of the chamber 304 and chamber 306 need not be the same (b'≠b").

The upper chamber 304 includes a top wall 308 and a bottom wall 310 as well as side walls 350 and 352, wherein the top and bottom walls 308 310 correspond to the broad walls of the chamber 304. The upper chamber 304 also includes a pair of opposed ferrite-containing slabs, namely 312 and 314, wherein one of the slabs 312 is located on the top wall 308 and the other slab 314 is located on the bottom wall 310. The ferrite-containing slabs 312 and 314 in the pair are substantially aligned with one another along axis "f" 370 and extend along at least a portion of the transmission passage defined by the chamber 304. In the example depicted, the two ferrite-containing slabs 312 314 are located offset from a center line of the chamber 304.

Analogously, the lower chamber 306 includes a top wall 308' and a bottom wall 310' as well as side walls 350' and 352', wherein the top and bottom walls 308' 310' correspond to the broad walls of the chamber 306. The lower chamber 306 also includes a pair of opposed ferrite-containing slabs, namely 312' and 314', wherein one of the slabs 312' is located on the top wall 308' and the other slab 314' is located on the bottom wall 310'. The ferrite-containing slabs 312' and 314' in the pair are substantially aligned with one another along axis "f" 370 and extend along at least a portion of the transmission passage defined by the lower chamber 306. In the example depicted, the two ferrite-containing slabs 312' 314' are located offset from a center line of the lower chamber 306 and are located on the same axis as the two ferrite-containing slabs 312 314 in the upper chamber 304.

During use, when suitably magnetized, the opposed pairs of ferrite-containing slabs 312/314 and 312'/314' generate a counter-rotating circularly polarized alternating magnetic field 318, which changes the phase of the microwave signal propagating within the transmission passages through chambers 304 and 306. In particular, the ferrite-containing slabs 312/314 and 312'/314' are magnetized and the generated magnetic field 316 is generally perpendicular to the direction of propagation of the microwave signal through the chambers 304 and 306, which essentially corresponds to the y-axis shown in FIG. 4A.

In FIG. 4B, the magnetic field 316 is shown as being produced by magnet 340.

Figure 4C:
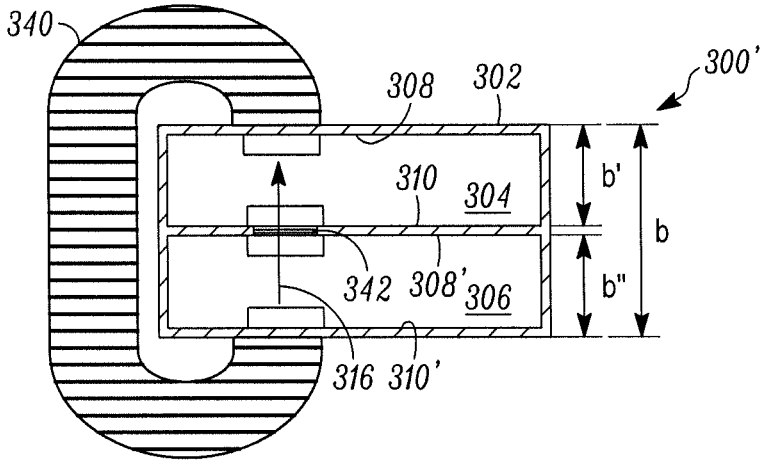
FIG. 4C shows a cross-section of the waveguide section of FIG. 4A together with magnets 340 and 342 in accordance with a variant.

A non-limiting variant of the embodiment depicted in FIGS. 4A and 4B is shown in FIG. 4C. In this variant, the waveguide section, denoted with reference numeral 300', includes a magnet 342 located between the wall 310 of the upper chamber 304 and the upper wall 308' of the bottom chamber 306. The remaining structure of the waveguide section 300' is substantially similar to the structure of the waveguide section 300 shown in FIGS. 4A and 4B and similar components have been identified using the same reference numeral and will not be described further here for the purpose of conciseness. The presence of magnet 342 located between the wall 310 of the upper chamber 304 and the upper wall 308' of the bottom chamber 306 may advantageously afford a more homogeneous distribution of the magnetic field between the ferrite slabs.

Figure 4D:
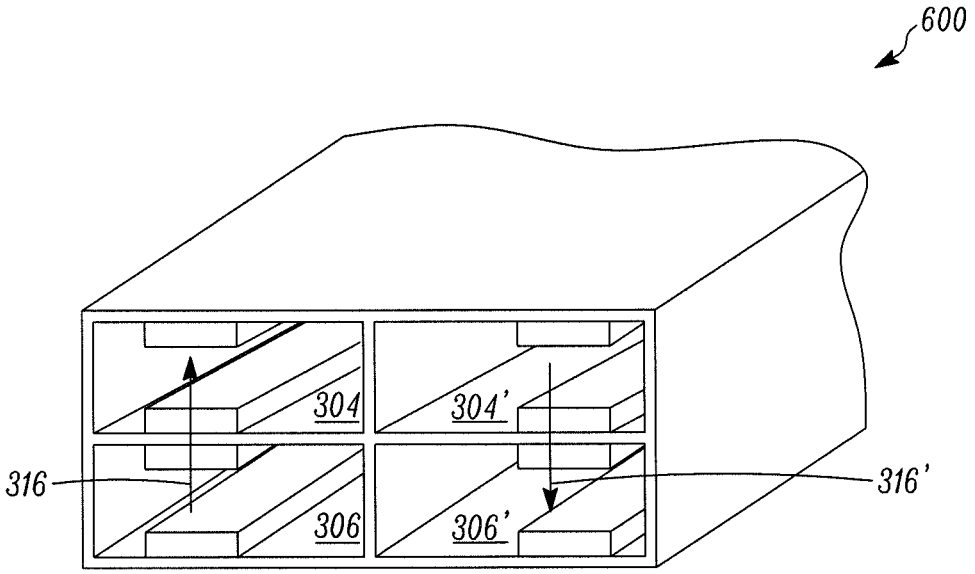
FIG. 4D shows a pair of waveguide sections of the type shown in FIG. 4A arranged side-by-side.

In practical implementations, magnets 340 and 342 depicted in FIGS. 4A, 4B and/or 4C may be implemented in any suitable known manner, for example they may be embodied as permanent magnets and/or electromagnets. In a practical implementation of a non-reciprocal phase shift device of the type depicted in FIG. 1, two side-by-side waveguide portions 25 and 25' of the type described with reference to FIG. 4A, 4B (or 4C), a portion 600 of which is illustrated in FIG. 4D.

Figure 5:
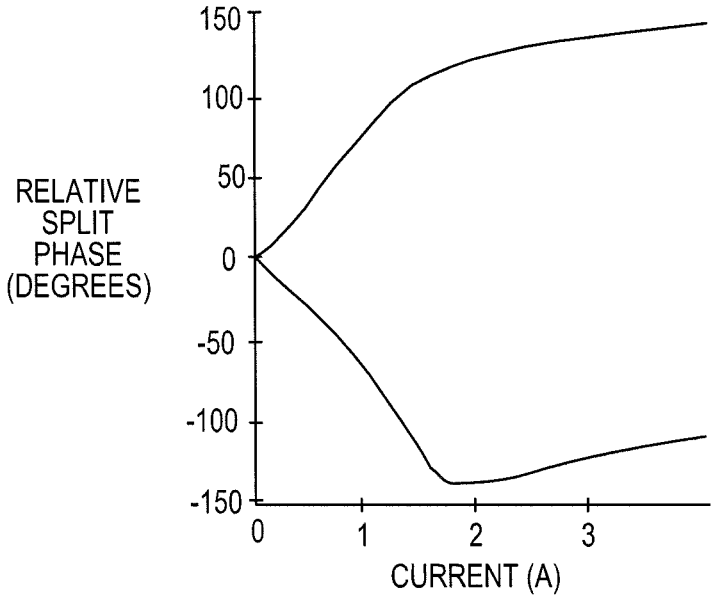
FIG. 5 is a graph showing experimental split phase constants obtained with a WR90 waveguide that includes a non-reciprocal phase shift device having waveguide phase shift sections of the type depicted in FIG. 2.
Figure 6:
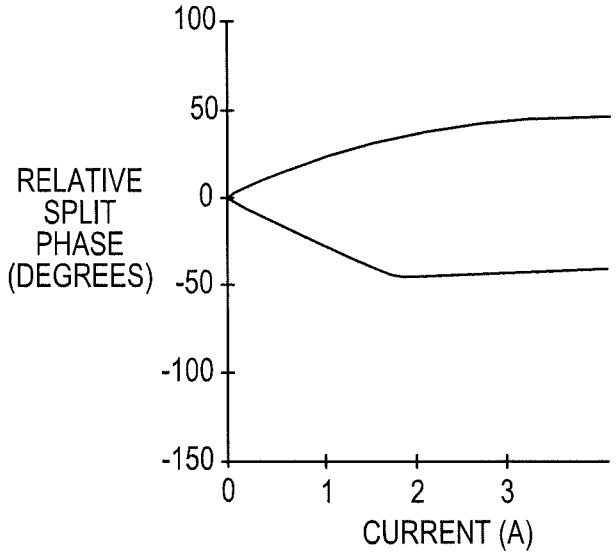
FIG. 6 is a graphic showing experimental split phase constants obtained with a WR90 waveguide that includes a non-reciprocal phase shift device having waveguide sections of the type depicted in FIG. 4A.

FIG. 5 is a graph showing experimental split phase constants at 9 GHz obtained with a WR90 waveguide that includes a non-reciprocal phase shift device having waveguide sections of the type depicted in FIG. 2. FIG. 6 is a graphic showing experimental split phase constants at 9 GHz obtained with a WR90 waveguide that includes a non-reciprocal phase shift device having waveguide sections of the type depicted in FIG. 4A. In this practical example, the ferrite-containing material used for the slabs 312 314 312' 314' shown in FIG. 4A is a magnesium manganese with a saturation magnetization equal to $\mu_0 M_0$=0.2150 T and a relative dielectric constant $\in_f$=12.7. FIG. 6 is a graph showing the relative/differential phase-shift between adjacent chambers of the particular configuration described with reference to FIG. 4A. The person skilled in the art will appreciate that it is desirable for the prior operation of the device to have a differential phase of 90 degrees.

Figure 7A:
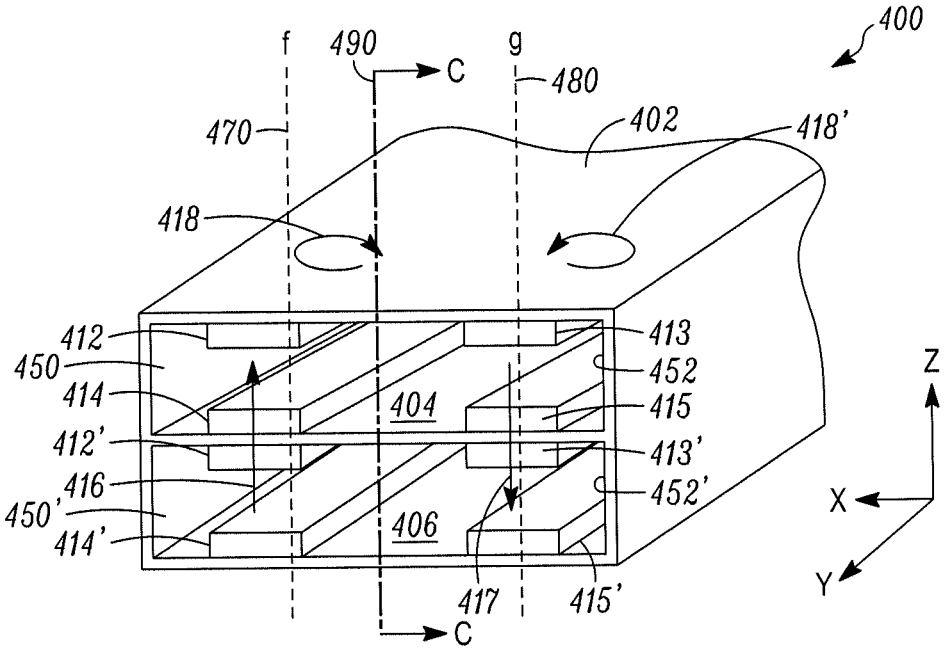
FIG. 7A shows a waveguide section of a non-reciprocal phase shift device having two stacked chambers in accordance with a fourth specific example of implementation of the invention.
Figure 7B:
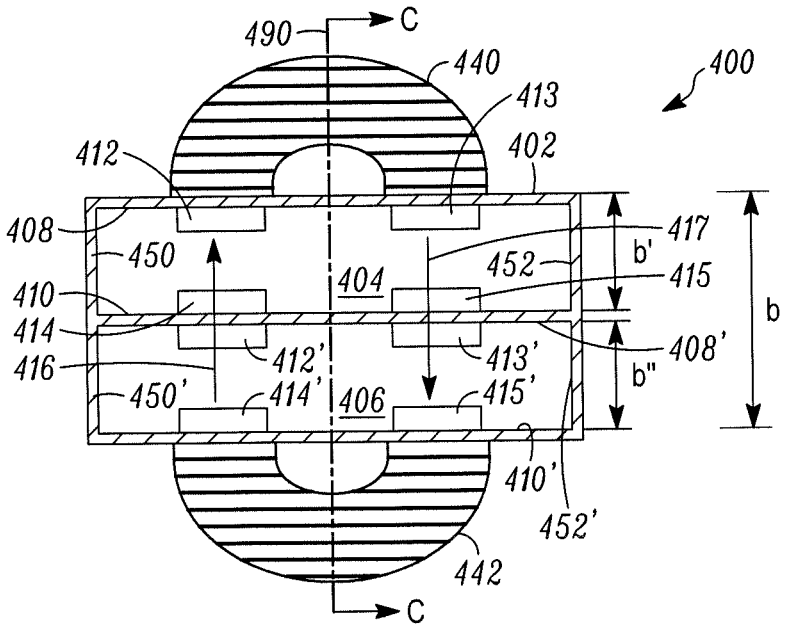
FIG. 7B shows a cross-section of the waveguide section depicted at FIG. 7A together with magnets 440 and 442 in accordance with a specific implementation of the invention.

FIGS. 7A and 7B show a portion of waveguide section 25 of the non-reciprocal phase shift device 20 shown in FIG. 1 in accordance with a fourth example of implementation (denoted with reference numeral 400 in FIGS. 7A and 7B). In the fourth example of implementation, the waveguide section 400 is comprised of a metal housing 402 in which are defined two stacked chambers 404 and 406, namely an upper chamber 404 and a lower chamber 406, having generally rectangular cross-sections and forming respective wave transmission passages. In the example depicted, the stacked chambers 404 406 have substantially similar dimensions and in particular the same height b' and b", where b/2=b'=b". It is however to be appreciated that in alternate embodiments (not shown in the Figures), the height of the chamber 404 and chamber 406 need not be the same (b'≠b" but where b=b'+b").

The upper chamber 404 includes top wall 408 and bottom wall 410 as well as side walls 450 and 452, wherein the top and bottom walls 408 410 correspond to the broad walls of the chamber 404. The upper chamber 404 also includes a first pair of opposed ferrite-containing slabs, namely 412 414, wherein one of the slabs 412 is located on the top wall 408 and the other slab 414 is located on the bottom wall 410. The ferrite-containing slabs 412 and 414 in the pair are substantially aligned with one another along axis "f" 470 and extend along at least a portion of the transmission passage defined by the chamber 404. In the example depicted, the two ferrite-containing slabs 412 414 are located offset from a center line of the chamber 404. The upper chamber 304 also includes a second pair of opposed ferrite-containing slabs, namely 413 and 415, wherein one of the slabs 413 is located on the top wall 408 and the other slab 414 is located on the bottom wall 410. The ferrite-containing slabs 413 and 415 in the second pair are substantially aligned with one another along axis "g" 480 and extend along at least a portion of the transmission passage defined by the chamber 304. In the example depicted, the two pairs of opposed ferrite-containing slabs 412 414 and 413 415 are located on alternate sides of a symmetry plane C 490 of the chamber 404 and offset from the center of the chamber 404.

Analogously, the lower chamber 406 has a top wall 408' and a bottom wall 410' as well as side walls 450' and 452', wherein the top and bottom walls 408' 410' correspond to the broad walls of the lower chamber 406. The lower chamber 406 also includes a first pair of opposed ferrite-containing slabs, namely 412' and 414', wherein one of the slabs 412' is located on the top wall 408' and the other slab 414' is located on the bottom wall 410'. The ferrite-containing slabs 412' and 414' in the pair are substantially aligned with one another along axis "f" 470 (shown in FIG. 7A) and extend along at least a portion of the transmission passage defined by the lower chamber 406. In the example depicted, the two ferrite-containing slabs 412' 414' are located offset from a center line of the lower chamber 406 and are located on the same axis "f" 470 as the two ferrite-containing slabs 412 414 in the upper chamber 404.

The lower chamber 406 also includes a second pair of opposed ferrite-containing slabs, namely 413' and 415', wherein one of the slabs 412' is located on the top wall 408' and the other slab 415' is located on the bottom wall 410'. The ferrite-containing slabs 413' and 415' in the pair are substantially aligned with one another along axis "g" 480 (shown in FIG. 7A) and extend along at least a portion of the transmission passage defined by the lower chamber 406. In the example depicted, the two ferrite-containing slabs 413' 415' are located offset from a center line of the lower chamber 406 and are located on the same axis "g" 480 as the two ferrite-containing slabs 413 415 in the upper chamber 404. In the example depicted, the two pairs of opposed ferrite-containing slabs 412' 414' and 413' 415' in the lower chamber 406 are located on alternate sides of a symmetry plane C 490 of the chamber 406 and offset from the center of the chamber 406.

During use, when suitably magnetized, the opposed pairs of ferrite-containing slabs 312/314 and 312'/314' generate a counter-rotating circularly polarized alternating magnetic field 318, which changes the phase of the microwave signal propagating within the transmission passages through chambers 304 and 306.

During use, when suitably magnetized using magnets 440 and 442, the opposed pairs of ferrite-containing slabs 412/414, 412'/414', 413/415 and 413' and 415' generate a counter-rotating circularly polarized alternating magnetic fields 418 and 418' causing direct magnetic fields 416 and 416' to be established. The direct magnetic fields 416 and 416' are opposite one another and generally perpendicular to the direction of propagation of the microwave signal through the chambers 404 and 406, which essentially corresponds to the y-axis shown in FIG. 7A. The counter-rotating circularly polarized alternating magnetic fields 418 and 418' on either side of the symmetry plane C affect a phase shift in microwave signals propagating through the transmission passages formed by chambers 404 and 406. In FIG. 7B, the magnetic fields 416 and 416' are shown as being produced by magnets 440 and 442. The person of skill will readily understand that magnets 440 and 442 may be permanent magnets, or electromagnets, or a combination thereof.

Figure 7C:
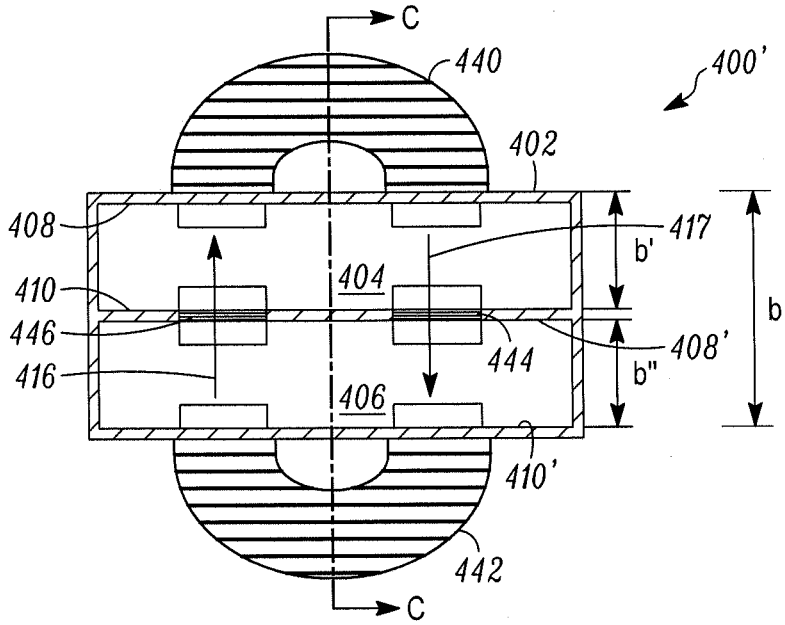
FIG. 7C shows a cross-section of the waveguide section depicted at FIG. 7A together with magnets 440, 442, 444 and 446 in accordance with a variant.
Figure 7D:
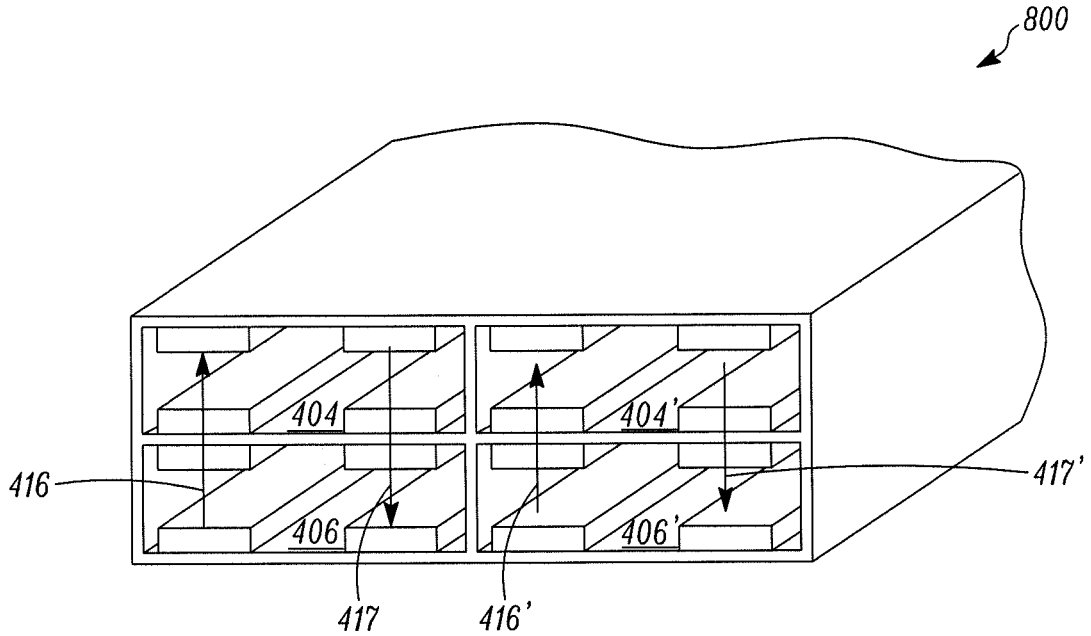
FIG. 7D shows a pair of waveguide sections of the type shown in FIG. 7A arranged side-by-side.

A non-limiting variant of the embodiment depicted in FIGS. 7A and 7B is shown in FIG. 7C. In this variant, the waveguide section, denoted with reference numeral 400', includes additional magnets 446 and 444 located between the wall 410 of the upper chamber 404 and the upper wall 408' of the bottom chamber 406. The remaining structure of the waveguide section 400' is substantially similar to the structure of the waveguide section 400 shown in FIGS. 7A and 7B and similar components have been identified using the same reference numerals and will not be described further here for the purpose of conciseness. The presence of magnets 446 and 444 located between the wall 410 of the upper chamber 404 and the upper wall 408' of the bottom chamber 406 may afford a more homogeneous distribution of the magnetic field between ferrite slabs.

In practical implementations, magnets 440, 442, 446 and 444 depicted in FIGS. 7A, 7B and/or 7C may be implemented in any suitable known manner, for example they may be embodied as permanent magnets and/or electromagnets.

In a practical implementation of a non-reciprocal phase shift device of the type depicted in FIG. 1, two side-by-side waveguide portions 25 and 25' of the type described with reference to FIG. 7A, 7B (or 7C), a portion 800 of which is illustrated in FIG. 4D.

While the embodiments illustrated in FIGS. 4A, 4B, 4C, 7A, 7B, and 7C show waveguide sections having specific configurations and suitable for use in connection with a non-reciprocal phase shift device of the type depicted in FIG. 1, the person skilled in the art will appreciate that variants of such waveguide sections are possible.

For example, while the examples of waveguide sections described above with reference to FIGS. 4A, 4B and 4C were shown as having two stacked chambers, variants of such sections may include three, four, five or more staked chambers. In such variants, the stacked chambers would include respective pairs of opposed ferrite-containing slabs aligned along a same axis. Similarly, while the examples of waveguide sections described above with reference to FIGS. 7A, 7B and 7C were shown as having two stacked chambers, variants of such sections may also include three, four, five or more stacked chambers. In such variants, the stacked chambers would also include two respective pairs of opposed ferrite-containing slabs aligned along two axes located on either side of a symmetry plane of the chambers, in a manner similar as that depicted with reference to FIG. 7A with axes "f" 470 and "g" 480.

In another example, while the examples of waveguide sections described above with reference to FIGS. 4A, 4B, 4C, 7A, 7B and 7C were shown as having stacked chamber with substantially similar dimensions and in particular substantially similar heights, variants of such sections may include stacked chambers having different heights.

In yet another example, while the examples of waveguide sections described above with reference to FIGS. 4A, 4B, 4C, 7A, 7B and 7C were shown as having ferrite containing slabs having a generally rectangular configuration, it is to be appreciated that the ferrite containing slabs may have any suitable shape and be sized in accordance with techniques known in the art.

Other variants and modifications to the examples of waveguide sections presented in the present document will become readily apparent to the person skilled in the art in light of the present description.

Non-reciprocal phase shift devices of the type depicted in FIG. 1, and having sections 25 25' with a configuration of the type described with reference to FIGS. 4A, 4B, 4C, 7A, 7B and/or 7C, can be constructed of one or more metal pieces machinable by precision metal working machines of the type known in the art of waveguides. The ferrite-containing slabs will typically include ferrite-containing materials known in the art of waveguides having suitable magnetic properties, such as for example, materials including iron oxide with impurities of other oxides, lithium ferrite materials, magnesium manganese ferrite materials, nickel ferrite materials, and the like.

Figure 8:
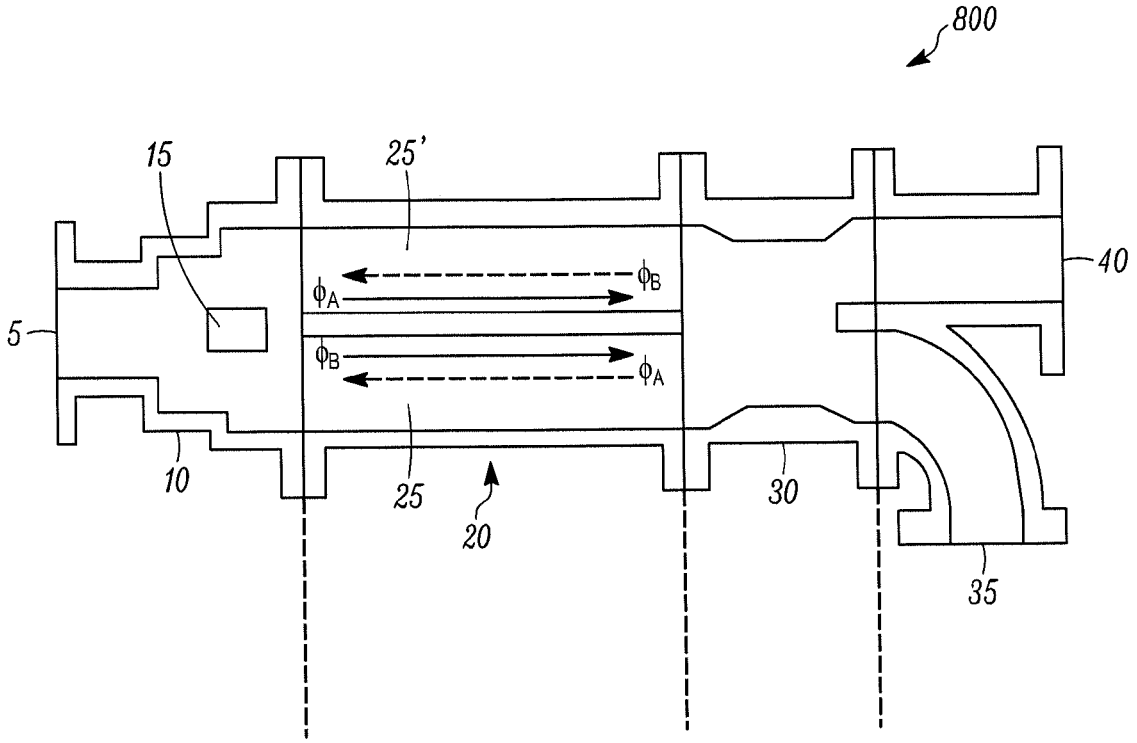
FIG. 8 shows a diagram of a 4-port differential phase shift circulator including the non-reciprocal phase shift device shown in FIG. 1 in accordance with a specific example of implementation of the invention.

Non-reciprocal phase shift devices of the type depicted in FIG. 1, and having sections 25 25' with a configuration of the type described with reference to FIGS. 2, 3, 4A, 4B, 4C, 7A, 7B and/or 7C, may be used in various microwave circuits to provide phase shift functionality. FIG. 8 of the drawings shows a non-limiting example in which the non-reciprocal phase shift device 20 of the type depicted in FIG. 1 is used as a component of a 4-port differential phase circulator 800. In the example depicted, the circulator 800 includes a folded magic T 10 and a 3 dB sidewall hybrid 30 between which is placed the non-reciprocal phase shift device 20, wherein the non-reciprocal phase shift device 20 has section 25 configured according to any of the configurations described with reference to FIGS. 2, 3, 4A, 4B, 4C, 7A, 7B and/or 7C. Section 25', which is placed side-by-side with section 25, has a configuration that is substantially similar to section 25.

The foregoing is considered as illustrative only of the principles of the invention. Since numerous modifications and changes will become readily apparent to those skilled in the art in light of the present description, it is not desired to limit the invention to the exact examples and embodiments shown and described, and accordingly, suitable modifications and equivalents may be resorted to. It will be understood by those of skill in the art that throughout the present specification, the term "a" used before a term encompasses embodiments containing one or more to what the term refers. It will also be understood by those of skill in the art that throughout the present specification, the term "comprising", which is synonymous with "including," "containing," or "characterized by," is inclusive or open-ended and does not exclude additional, un-recited elements or method steps.

Unless otherwise defined, all technical and scientific terms used herein have the same meaning as commonly understood by one of ordinary skill in the art to which this invention pertains. In the case of conflict, the present document, including definitions will control.

Although the present invention has been described in considerable detail with reference to certain embodiments thereof, variations and refinements are possible and will become apparent to persons skilled in the art in light of the present description.

For example, while the non-reciprocal gyromagnetic phase shift device 20 depicted in FIG. 1, having waveguide sections configured in a manner described with reference to FIGS. 2, 3, 4A, 4B, 4C, 7A, 7B and 7C, has been shown as a standalone device which may be coupled to other microwave devices, for example to form microwave propagation circuits of the type shown in FIG. 8, it will be appreciated that in other implementation non-reciprocal gyromagnetic phase shift devices using the concepts presented in the present document may be otherwise constructed. For example, in accordance with a variant not shown in the drawings, a non-reciprocal gyromagnetic phase shift device using the concepts presented in the present document may be constructed as one component of a multi-component waveguide assembly of the type described for example in U.S. Pat. No. 8,324,990 to N. Vouloumanos on Dec. 4, 2012. The contents of the aforementioned document are incorporated herein by reference. Such a multi-component waveguide assembly would include the non-reciprocal gyromagnetic phase shift device as well as at least one or more other waveguide component, such as for example a folded magic T, a 3 dB sidewall hybrid, a transmit filter, a harmonic filter and(or) a circulator. In addition, as will be appreciated by persons skilled in the art, in such a variant of a non-reciprocal gyromagnetic phase shift device, one or both coupling members 32 and 30 of the type depicted in the embodiment of FIG. 1 may be omitted in such cases as appropriate and as will be readily apparent to the person skilled in the art.

The invention is defined more particularly by the attached claims.

The invention claimed is:

1. A non-reciprocal gyromagnetic phase shift device for microwave signals, said device comprising a section of waveguide having at least two stacked chambers in each of which ferrite-containing slabs are arranged opposite one another on top and bottom walls of the stacked chambers along a common axis, in use a magnetic field being applied to said section of waveguide along the common axis along which are positioned said ferrite-containing slabs.

2. A non-reciprocal gyromagnetic phase shift device as defined in claim 1, said device further comprising at least one magnet configured for causing the magnetic field to be applied to said section of waveguide along the common axis.

3. A non-reciprocal gyromagnetic phase shift device as defined in claim 1, wherein said ferrite-containing slabs are located at a position offset from a center line of said at least two stacked chambers.

4. A non-reciprocal gyromagnetic phase shift device as defined in claim 1, wherein said at least two stacked chambers include at least three stacked chambers.

5. A non-reciprocal gyromagnetic phase shift device as defined in claim 1, wherein said at least two stacked chambers include at least four stacked chambers.

6. A 4-port differential phase shift circulator comprising the non-reciprocal gyromagnetic phase shift device as defined in claim 1.

7. A 4-port differential phase shift circulator comprising a folded magic tee portion, a non-reciprocal phase shift device portion and a 3 dB hybrid coupler portion, wherein the non-reciprocal phase shift device portion includes a non-reciprocal gyromagnetic phase shift device as defined in claim 1.

8. A non-reciprocal gyromagnetic phase shift device as defined in claim 1, wherein said section of waveguide is a section of rectangular waveguide and wherein said at least two stacked chambers have generally rectangular cross-sectional shapes.

9. A non-reciprocal gyromagnetic phase shift device as defined in claim 8, wherein the ferrite-containing slabs extend longitudinally along at least a portion of the section of waveguide.

10. A non-reciprocal gyromagnetic phase shift device as defined in claim 8, wherein application of the magnetic field causes respective counter-rotating circularly polarized alternating magnetic fields to be generated in the at least two stacked chambers.

11. A non-reciprocal gyromagnetic phase shift device as defined in claim 8, wherein said at least two stacked chambers have substantially similar dimensions to one another.

12. A non-reciprocal gyromagnetic phase shift device as defined in claim 8, wherein said at least two stacked chambers have substantially similar heights.

13. A non-reciprocal gyromagnetic phase shift device as defined in claim 1, wherein:

a. the common axis is a first common axis and wherein the ferrite-containing slabs arranged along said first common axis form a first set of ferrite-containing slabs;

b. in use the magnetic field being applied to said section of waveguide along the first common axis is a first magnetic field;

c. in each of the at least two stacked chambers ferrite-containing slabs are arranged opposite one another on top and bottom walls of the stacked chambers and along a second common axis, the second common axis being distinct from the first common axis, the ferrite-containing slabs arranged along said second common axis forming a second set of ferrite-containing slabs;

d. in use a second magnetic field being applied to said section of waveguide along the second common axis.

14. A non-reciprocal gyromagnetic phase shift device as defined in claim 13, said device further comprising:

a. a first magnet configured for causing the first magnetic field to be applied to said section of waveguide along the first common axis along which are positioned the ferrite-containing slabs in said first set of ferrite-containing slabs; and b. a second magnet configured for causing the second magnetic field to be applied to said section of waveguide along the second common axis along which are positioned the ferrite-containing slabs in said second set of ferrite-containing slabs.

15. A non-reciprocal gyromagnetic phase shift device as defined in claim 13, wherein said first magnetic field is of inverse polarity relative to said second magnetic field.

16. A non-reciprocal gyromagnetic phase shift device as defined in claim 15, wherein said first common axis and said second common axis are arranged substantially on either side of a symmetry plane extending longitudinally along a length of the section of waveguide.

17. A non-reciprocal gyromagnetic phase shift device for microwave signals comprising a section of waveguide including:

a. a first chamber defining a first microwave transmission passage, said first chamber including a first pair of ferrite-containing slabs wherein one element of said first pair is positioned on a first wall of said first chamber and an other element of said first pair is positioned on a second wall of said first chamber, said first wall of said first chamber being positioned opposite said second wall of said first chamber;

b. a second chamber stacked upon said first chamber along an axis, the second chamber defining a second microwave transmission passage, said second chamber including a second pair of ferrite-containing slabs wherein one element of said second pair is positioned on a first wall of said second chamber and an other element of said second pair is positioned on a second wall of said second chamber, said first wall of said second chamber being positioned opposite said second wall of said second chamber;

c. said first pair of ferrite-containing slabs and said second pair of ferrite-containing slabs being positioned substantially along the axis along which the first chamber and the second chamber are stacked;

d. in use a magnetic field being applied through said first and second chambers along the axis along which the first chamber and the second chamber are stacked.

18. A non-reciprocal gyromagnetic phase shift device as defined in claim 17, wherein said section of waveguide is a section of a rectangular waveguide, and wherein first and second chambers have generally rectangular cross-sectional shapes.

19. A non-reciprocal gyromagnetic phase shift device as defined in claim 18, wherein the pairs of ferrite-containing slabs extend longitudinally along at least a portion of the section of waveguide.

20. A non-reciprocal gyromagnetic phase shift device as defined in claim 18, wherein application of the magnetic field causes respective counter-rotating circularly polarized alternating magnetic fields to be generated in the at least two stacked chambers.

21. A non-reciprocal gyromagnetic phase shift device as defined in claim 18, wherein said at least two stacked chambers have substantially similar dimensions to one another.

22. A non-reciprocal gyromagnetic phase shift device as defined in claim 18, wherein said at least two stacked chambers have substantially similar heights.

* * * * *